US011506169B2

(12) United States Patent
Lowery et al.

(10) Patent No.: US 11,506,169 B2
(45) **Date of Patent: *Nov. 22, 2022**

(54) COMBUSTION ENVIRONMENT DIAGNOSTICS

(71) Applicant: West Virginia University, Morgantown, WV (US)

(72) Inventors: Andrew D. Lowery, Morgantown, WV (US); Michael J. Spencer, Morgantown, WV (US); James E. Smith, Bruceton Mills, WV (US)

(73) Assignee: WEST VIRGINIA UNIVERSITY, Morgantown, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/237,211

(22) Filed: Apr. 22, 2021

(65) Prior Publication Data

US 2021/0310457 A1 Oct. 7, 2021

Related U.S. Application Data

(60) Division of application No. 16/363,357, filed on Mar. 25, 2019, now Pat. No. 10,989,162, which is a (Continued)

(51) Int. Cl.
*F02P 23/04* (2006.01)
*F02P 3/01* (2006.01)
(Continued)

(52) U.S. Cl.
CPC ..... *F02P 23/045* (2013.01); *F02P 3/01* (2013.01); *F02P 9/007* (2013.01); *H01P 7/04* (2013.01); *H01P 7/06* (2013.01); *H01T 13/50* (2013.01)

(58) Field of Classification Search
CPC .... F02P 3/01; F02P 9/007; F02P 17/12; F02P 23/045; H01T 5/00; H01T 19/04
See application file for complete search history.

(56) References Cited

U.S. PATENT DOCUMENTS 3,934,566 A * 1/1976 Ward ..... F02P 23/04 123/275
5,361,737 A * 11/1994 Smith ..... F02P 9/007 123/143 B (Continued)

FOREIGN PATENT DOCUMENTS

FR 2962105 A1 * 1/2012 ..... B60N 2/002
WO WO-2010011838 A1 * 1/2010 ..... F02P 17/12
WO WO-2012103112 A2 * 8/2012 ..... F02P 23/00

*Primary Examiner* — Phutthiwat Wongwian
*Assistant Examiner* — Anthony L Bacon
(74) *Attorney, Agent, or Firm* — Thomas | Horstemeyer, LLP

(57) ABSTRACT

An apparatus for igniting a combustible mixture. In one example, the apparatus can include a coaxial cavity resonator assembly in a combustion environment. The apparatus can also include an operational feedback system and a controller. The operational feedback system can measure at least one of a voltage value and a current value of the coaxial cavity resonator assembly in the combustion environment. The controller can be configured to determine a condition of the coaxial cavity resonator assembly and modulate operation of the coaxial cavity resonator assembly based at least in part on the determined condition.

20 Claims, 14 Drawing Sheets

Related U.S. Application Data continuation of application No. 15/311,416, filed as application No. PCT/US2015/031451 on May 18, 2015, now abandoned.

(60) Provisional application No. 61/994,332, filed on May 16, 2014.

(51) Int. Cl.

| | |
|---|---|
| ***F02P 9/00*** | (2006.01) |
| ***H01P 7/04*** | (2006.01) |
| ***H01P 7/06*** | (2006.01) |
| ***H01T 13/50*** | (2006.01) |

(56) References Cited

U.S. PATENT DOCUMENTS 5,689,949 A * 11/1997 DeFreitas ..... F02P 23/045 219/121.36
7,721,697 B2 * 5/2010 Smith ..... F02P 9/007 123/607
8,746,218 B2 * 6/2014 Freen ..... F02P 17/12 123/623
2010/0282198 A1 * 11/2010 Hampton ..... F02P 23/04 315/276
2011/0146607 A1 * 6/2011 Smith ..... F02P 9/007 123/143 B
2011/0175691 A1 * 7/2011 Smith ..... F02P 3/01 333/222
2011/0298376 A1 * 12/2011 Kanegae ..... H05H 1/2406 315/111.51
2012/0180742 A1 * 7/2012 Burrows ..... F02P 15/10 123/143 B
2012/0258016 A1 * 10/2012 Makita ..... H05H 1/52 123/3
2013/0199508 A1 * 8/2013 Toedter ..... F02P 5/1502 123/594
2013/0319384 A1 * 12/2013 Trump ..... F02P 23/04 123/623
2014/0123924 A1 * 5/2014 McAlister ..... F02M 51/061 123/143 B
2015/0287574 A1 * 10/2015 Spencer ..... H05H 1/46 315/39

* cited by examiner

The Basic Components of a two stroke engine

COMBUSTION ENVIRONMENT DIAGNOSTICS

CROSS REFERENCE TO RELATED APPLICATIONS

This application is a divisional of, claims priority to, and the benefit of, U.S. Ser. No. 16/363,357, filed Mar. 25, 2019 and entitled "Combustion Environment Diagnostics," which is a continuation of, claims priority to, and the benefit of, U.S. Ser. No. 15/311,416, filed Nov. 15, 2016 and entitled "Combustion Environment Diagnostics," which claims priority to and the benefit of 371 International Application PCT/US2015/031451, filed on May 18, 2015, which claims priority to, and the benefit of U.S. Provisional Application No. 61/994,332, in which each of these applications are incorporated by reference herein in their entireties.

TECHNICAL FIELD

This technology relates generally to the field of electrical ignition of combustible materials, and more particularly to applications and methods of diagnosing conditions within a combustion chamber.

BACKGROUND

There are at least two basic methods used to ignite combustion mixtures in the prior art. Those include autoignition through compression and spark ignition. Today a very large number of spark ignited (SI) engines are in use, consuming a limited fossil fuel supply. A significant environmental and economic benefit is obtained by making combustion engines more efficient. Higher thermal efficiencies for SI engines are obtained through operation with leaner fuel air mixtures and through operations at higher power densities and pressures. Unfortunately, as mixtures are leaned, they become more difficult to ignite and combust. More energetic sparks with larger surfaces are required for reliable operation, for example using multiple spark plugs per cylinder systems or rail-plug igniters. As more energetic sparks are used, their overall ignition efficiency is reduced because the higher energy levels are detrimental to the spark plug lifetime. This needs work. These higher energy levels also contribute to the formation of undesirable pollutants plus the overall reduction in engine efficiency.

Radio frequency (RF) plasma ignition sources provide an alternative to traditional direct current (DC) spark ignition and open the door to more efficient, leaner, and cleaner combustion resulting in associated economic and environmental benefits. One method of generating plasma involves using a RF source and standing electromagnetic waves to generate corona discharge plasma. The prior art uses a RF oscillator and amplifier to generate the required RF power at a desired frequency. RF oscillators and amplifiers can be either semiconductor or electron tube based, and are well known in the art. The RF oscillator and amplifier are coupled to the quarter wave coaxial cavity resonator, which in turn develops a standing RF wave in the cavity at the frequency determined by the RF oscillator and the resonant frequency of the cavity. By electrically shorting the input end of the quarter wave coaxial cavity resonator and leaving the other end electrically open, the RF energy is resonantly stepped-up in the cavity to produce a corona discharge plasma at the open end of the quarter wave coaxial cavity resonator. The corona discharge plasma can function generally as an ignition means for combustible materials and specifically in a combustion chamber of a combustion engine.

SUMMARY

Each of the following summary paragraphs describes a non-limiting example of how the invention may be implemented as a combination of structural or method elements disclosed by the detailed description that follows. Any one or more of the elements of each summary paragraph may be utilized with any one or more of the distinct elements of another.

An apparatus for igniting a combustible mixture comprises a coaxial cavity resonator configured to create a plasma discharge; a radio frequency power source coupled to the coaxial cavity resonator; a direct current power source coupled to the coaxial cavity resonator; a combustion process feedback module configured to sense a condition in a combustion environment by measuring a characteristic of the coaxial cavity resonator; and a controller configured to modulate operation of the coaxial cavity resonator based at least in part on combustion process feedback information from the combustion process feedback module. The apparatus can further comprise an internal combustion engine and wherein the combustion environment is a cylinder of the internal combustion engine. The controller can be further configured to modulate operation of the coaxial cavity resonator during a single combustion cycle based at least in part on the combustion process feedback information from the combustion process feedback module.

The apparatus can further comprise a motor vehicle configured to be powered by the internal combustion engine. The motor vehicle can be an automobile that includes a chassis supporting the internal combustion engine, a transmission driven by the internal combustion engine, a drive axle driven by the transmission, at least two drive wheels operatively coupled to the drive axle, a steering mechanism, at least two steering wheels operatively coupled to the steering mechanism, and a body attached the chassis.

An apparatus comprises a coaxial cavity resonator; a radio frequency power source coupled to the coaxial cavity resonator; a direct current power source coupled to the coaxial cavity resonator; an operation feedback module configured to sense a condition of the coaxial cavity resonator by measuring a characteristic of the coaxial cavity resonator; and a controller configured to modulate ignition of a combustible mixture in a combustion environment based at least in part on operation feedback information from the operation feedback module. The apparatus can further comprise an internal combustion engine and the combustion environment can be a cylinder of the internal combustion engine. The apparatus can further comprise a motor vehicle configured to be powered by the internal combustion engine. The motor vehicle can be an automobile that includes a chassis supporting the internal combustion engine, a transmission driven by the internal combustion engine, a drive axle driven by the transmission, at least two drive wheels operatively coupled to the drive axle, a steering mechanism, at least two steering wheels operatively coupled to the steering mechanism, and a body attached the chassis.

An apparatus comprises a coaxial cavity resonator; a radio frequency power source coupled to the coaxial cavity resonator; a direct current power source coupled to the coaxial cavity resonator; an operation feedback module configured to sense a condition of the coaxial cavity resonator by measuring a characteristic of the coaxial cavity resonator; and a controller configured to modulate ignition of a combustible mixture in a combustion environment based at least in part on operation feedback information from the operation feedback module. The apparatus can further comprise a combustion feedback module configured to sense a condition of the combustion environment. The controller can be further configured to modulate operation of the coaxial cavity resonator based at least in part on combustion feedback information from the combustion feedback module. The apparatus can further comprise an internal combustion engine and wherein the combustion environment is a cylinder of the internal combustion engine. The apparatus can further comprise a motor vehicle configured to be powered by the internal combustion engine. The motor vehicle can be an automobile that includes a chassis supporting the internal combustion engine, a transmission driven by the internal combustion engine, a drive axle driven by the transmission, at least two drive wheels operatively coupled to the drive axle, a steering mechanism, at least two steering wheels operatively coupled to the steering mechanism, and a body attached the chassis.

A method, comprises measuring at least one of a voltage value and a current value of a coaxial cavity resonator in a combustion environment; determining a condition of the coaxial cavity resonator by comparing the measured value to a known possible condition state; and modulating operation of the coaxial cavity resonator based at least in part on the determined condition. The combustion environment can be a cylinder of an internal combustion engine. The method can further comprise measuring a condition of the combustion environment by using an auxiliary sensor. Modulating operation of the coaxial cavity resonator can be based at least in part on a condition measurement of the combustion environment by the auxiliary sensor.

BRIEF DESCRIPTION OF THE DRAWINGS

A brief description of each figure is provided below. Elements with the same reference numbers in each figure indicate identical or functionally similar elements. Additionally, as a convenience, the left-most digit(s) of a reference number identifies the drawings in which the reference number first appears.

DETAILED DESCRIPTION

This written description is provided to meet the enablement requirements of the patent statute without imposing limitations that are not recited in the claims. All or part of each example may be used in combination with all or part of any one or more of the other examples.

Prior Art Ignition System with a Spark Plug

Figure 1:
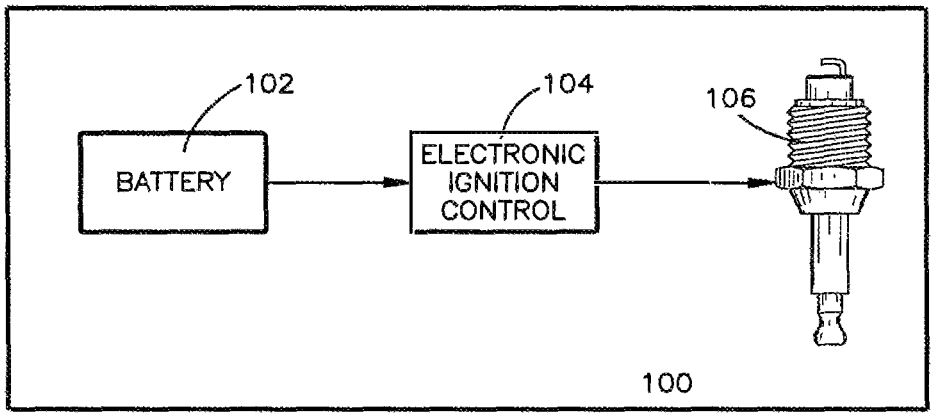
Fig. 1 PRIOR ART
FIG. 1 is a schematic diagram of a prior art ignition system using a spark plug as an ignition source.

Referring now to the schematic diagram of a prior art ignition system 100 depicted in FIG. 1, a battery 102 connects to an electronic ignition control system 104 which is connected by a spark plug wire to a spark plug 106.

In a typical prior art ignition system 100, like that found in an automobile, a battery 102 provides electrical power to an electronic ignition control system 104. The electronic ignition control system 104 determines the proper timing for triggering an ignition event, and at the appropriate time sends a high voltage direct current (DC) pulse via a spark plug wire to the terminal end of a spark plug 106. The high voltage pulse causes a spark to discharge at the tip of the spark plug 106 that is displaced inside of a combustion chamber (not shown). The spark ignites combustible material, such as gasoline vapor, that is inside the combustion chamber of a combustion engine, completing the ignition sequence.

Prior Art Ignition System with a Coaxial Cavity Resonator

Figure 2:
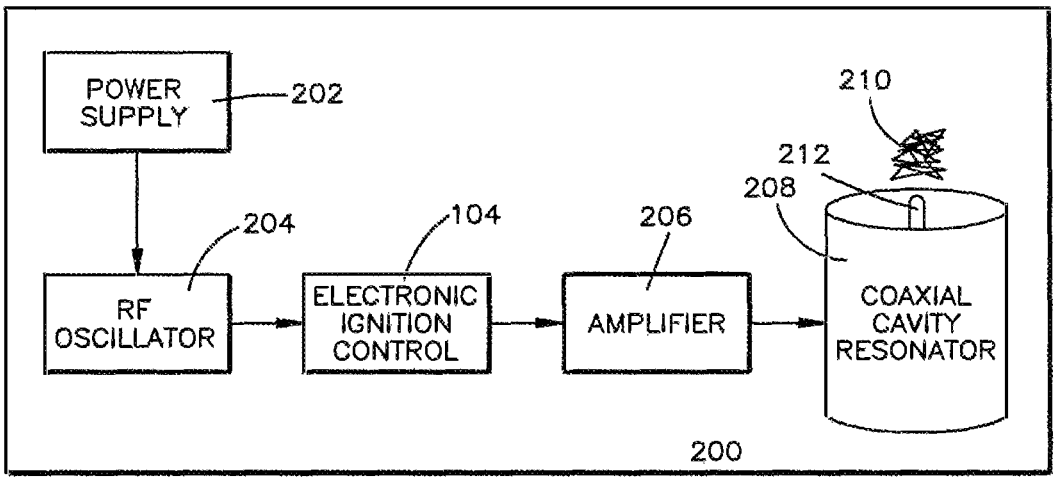
Fig. 2 PRIOR ART
FIG. 2 is a schematic diagram of a prior art ignition system using a coaxial cavity resonator as an ignition source.

Referring now to the schematic diagram of a prior art coaxial cavity resonator ignition system 200 depicted in FIG. 2, a power supply 202 connects to a radio frequency (RF) oscillator 204 that is connected through an electronic ignition control system 104 to an amplifier 206 that is connected to a coaxial cavity resonator 208. An exemplary system using a coaxial cavity resonator 208 is described in U.S. Pat. No. 5,361,737 to Smith et al. herein incorporated by reference as part of this description. Also incorporated by reference as part of this description are U.S. Patent Publications 2011/0146607 and 2011/0175691. A coaxial cavity resonator may also be referred to as a quarter wave coaxial cavity resonator (QWCCR).

In one example of the prior art coaxial cavity resonator ignition system, the power supply 202 provides electrical power to an RF oscillator 204. The RF oscillator 204 generates an RF signal at a frequency chosen to approximate the resonant frequency of the coaxial cavity resonator 208. The RF oscillator 204 delivers the RF signal to an electronic ignition control system 104 that determines the proper timing for triggering an ignition event, and at the appropriate time forwards the RF signal to the amplifier 206 for amplification. The amplifier 206 amplifies the RF signal to the proper power to create sufficiently energetic corona discharge plasma 210 at the discharge tip of a center conductor of the coaxial cavity resonator 208 to ignite a combustible material in the combustion chamber of a combustion engine. The particular combination of components that provide the RF signal to the QWCCR may vary in different examples of the prior art.

The QWCCR 208 creates microwave plasma by inducing electrical breakdown of a gas mixture using an electric field. In one example, the prior art QWCCR 208 consists of a quarter wavelength resonant coaxial cavity into which electromagnetic energy is coupled resulting in a standing electromagnetic field. The RF oscillations are between about 750 MHz and 7.5 GHz. A coaxial cavity resonator 208 measuring between 1 to 10 cm long approximately corresponds to an operating frequency in the range of 750 Mhz to 7.5 Ghz. The advantage of generating frequencies in this range is that it allows the geometry of a body containing the coaxial cavity resonator 208 to be dimensioned approximately the size of the prior art spark plug 106.

Ignition System with a Coaxial Cavity Resonator Using Both Radio Frequency Power and Direct Current Power In accordance with the present invention, an apparatus may further be configured using multiple resonators assembled in a configuration to generate a plasma by applying a combined amount of voltage from radio frequency power and direct current power. Such an apparatus 300 is shown for example in FIG. 3. In this particular example, the apparatus 300 is an assembly of two quarter wave coaxial cavity resonators that are coupled together. More specifically, the resonator assembly 300 shown for example in FIG. 3 includes first and second resonators 310 and 312 coupled in a series arrangement along a longitudinal axis 315.

In the illustrated example, the first and second resonators 310 and 312 are defined by a common outer conductor wall structure 320. The wall structure 320 includes first and second cylindrical walls 322 and 324 centered on the axis 315. The first wall 322 is constructed of a conducting material and surrounds a first cylindrical cavity 325 centered on the axis 315. The thickness of this material is based on its dielectric breakdown strength. It needs to be strong enough to suppress the current from the outer conductor to the inner conductor. In this example, the first cylindrical cavity 325 is filled with a dielectric material 326 having a relative dielectric constant approximately equal to four ($\varepsilon_r$=4). In this example, the first and second resonators 310 and 312 adjoin one another in a connection plane 332 that is perpendicular to the axis 315. In other examples, the connection plane 332 does not have to be perpendicular, and can change at any rate that maintains a constant impedance between the first and second resonators 310 and 312.

The second cylindrical wall 312 is constructed of a conducting material and surrounds a second cavity 345 that is also centered on the axis 315. The second cavity 345 is coaxial with the first cavity 325 but has a greater physical length. The second wall 312 provides the second cavity 345 with a distal end 347 spaced along the longitudinal axis 315 from the proximal end 349 of the second cavity 345.

A center conductor structure 350 is supported within the wall structure 320 of the resonator assembly 300 by the dielectric material 326. The center conductor structure 350 includes first and second center conductors 352 and 354 and a radial conductor 357. The first center conductor 352 reaches within the first cavity 325 along the axis 315. In the illustrated example, the first center conductor 352 has a proximal end 360 adjacent the proximal end 330 of the first cavity 325, and has a distal end 362 adjacent the distal end 349 of the first cavity 325. The radial conductor 357 projects radially from a location adjacent the distal end 362 of the first center conductor 352, across the first cavity 325, and outward through the aperture 339.

The second center conductor 354 has a proximal end 370 at the distal end 362 of the first center conductor 352, and projects along the axis 315 to a distal end 372 configured as an electrode tip located at or in close proximity to the distal end 347 of the respective cavity 345.

To minimize any mismatch in impedances between the first and second resonators 310 and 312, the relative radial thicknesses between both the cylindrical walls 322 and 324 and the respective center conductors 352 and 354 are defined in relation to the relative dielectric constant of the dielectric material 326 and the dielectric constant of the air that fills the second cavity 345. In the illustrated example, the physical length along the longitudinal axis 315 of the second center conductor 354 is approximately twice the physical length along the longitudinal axis 315 of the first center conductor 352. However, based at least in part on the dielectric material 326 having a relative dielectric constant approximately equal to four, the electrical lengths of the two center conductors are approximately equal. Note: any gaps between any center conductor and any outer conductor are either filled with a dielectric, or the gap is large enough to minimize arcing. As further shown in FIG. 3, the dielectric material 326 fills the first cavity 325 around the first center conductor 352 and the radial conductor 357.

Figure 3:
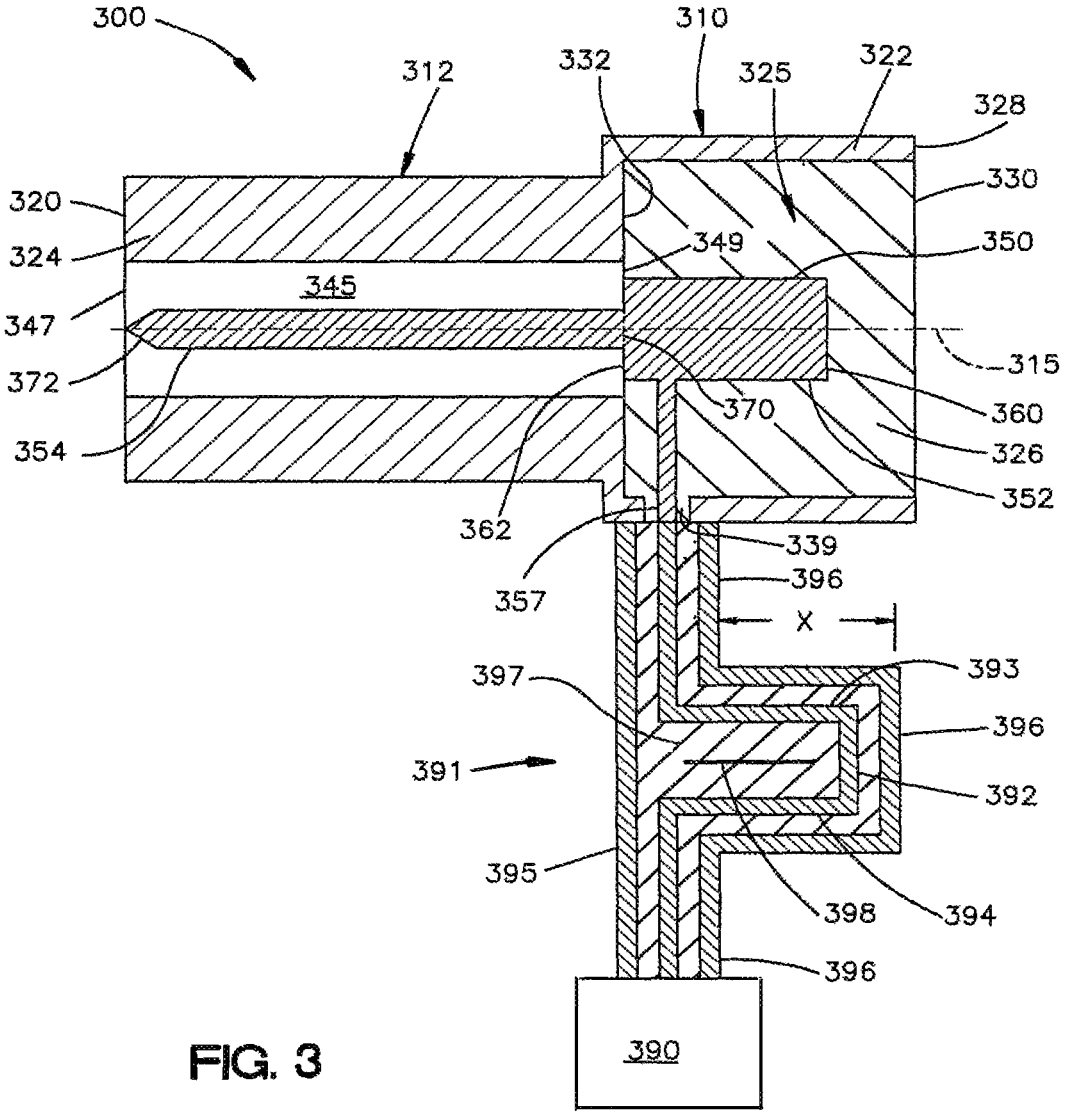
FIG. 3 is a cross-sectional view of an example of an exemplary coaxial cavity resonator assembly connected to a direct current power source through an additional resonator assembly acting as an RF attenuator.

In the illustrated example, a DC power source 390 is connected to the center conductor structure 350 through the radial conductor 357 connected adjacent to the virtual short circuit point. An RF control component, specifically, an RF frequency cancellation resonator assembly 391 is disposed between the radial conductor 357 and the DC power source 390 to restrict RF power from reaching the DC power source 390. The RF frequency cancellation resonator assembly is an additional resonator assembly 391 having a center conductor 392 with first and second portions 393 and 394, each of which has the same electrical length, X, as one another (and the same electrical length as the first and second center conductors 352 and 354). In a preferred example, the electrical length X denoted in FIG. 3 is equal to one quarter wavelength, or lambda/4, wherein wavelength is inversely related to the frequency of the RF power. The additional resonator assembly 391 also has a short outer conducting wall 395 and a long outer conducting wall 396. The short outer conducting wall 395 has first and second ends on opposite ends of the additional resonator assembly 391. The long outer conducting wall 396 also has first and second ends on opposite ends of the additional resonator assembly 391. The first and second ends of the short outer conducting wall 395 are each on the opposite side from the corresponding first and second ends of the long outer conducting wall 396.

The difference in electrical length between the short outer conducting wall 395 and the long outer conducting wall 396 is approximately equal to the combined electrical length of the first and second portions 393 and 394, which is also approximately equal to twice the electrical length of the first center conductor 352. The short outer conducting wall 395 and the long outer conducting wall 396 surround a cavity 397 filled with a dielectric material. Under active operation in this example, current running along the outer conductor of the additional resonator assembly 391 will primarily follow the shortest path and run along the short outer conducting wall 395. Accordingly, current on the outer conductor of the additional resonator assembly 391 will travel two fewer quarter wavelengths than current running along the center conductor 392 of the additional resonator assembly 391.

The additional resonator assembly 391 also has an internal conducting ground plane 398 disposed within the cavity 397 and between the first and second portions 393 and 394 of the center conductor 392. This arrangement provides a frequency cancellation circuit connected between the DC power source 390 and the radial conductor 357. The additional resonator assembly 391 is configured to shift a voltage supply of RF energy 180 degrees out of phase relative to the ground plane of the QWCCR assembly 300 due to the difference in electrical length between the short outer conducting wall 395 and the center conductor 392 of the additional resonator assembly 391.

Figure 4:
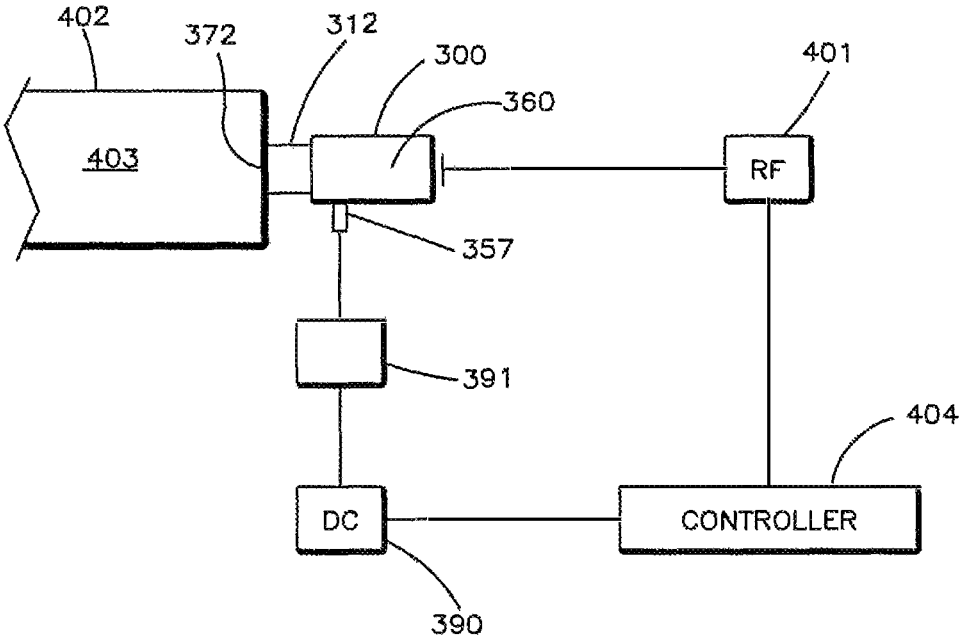
FIG. 4 is a schematic diagram of an example of a coaxial cavity resonator assembly operatively associated with a combustion chamber and wherein a controller directs both an RF power supply and a DC power supply to provide power to the coaxial cavity resonator assembly.

As shown schematically in FIG. 4, an RF power source 401 is coupled to the QWCCR assembly 300 across from the first center conductor 352, which is joined to a cylinder 402 in an internal combustion engine, with the electrode tip 372 exposed in a combustion chamber 403 in the cylinder 402. In this preferred example, a controller 404 is coupled to the RF power source 401 and the DC power source 390 for directing the power sources to supply voltages within specific parameters. The controller 404 may comprise any suitable programmable logic controller or other control device, or combination of control devices, that can be programmed or otherwise configured with hardware and/or software to perform as described and claimed.

When a plasma is to be generated adjacent the electrode tip 372 of the second center conductor 354, the controller 404 directs the RF power source 401 to capacitively couple a voltage supply of RF energy to the first center conductor 352, thereby creating a virtual short adjacent the distal end 362 of the first center conductor 352. This virtual short also couples the voltage supply of RF energy to the second center conductor 354. The voltage supply of RF energy is not sufficient on its own to generate a plasma, and is provided in a first ratio of power over voltage. The controller 404 also directs the DC power source 390 to provide a voltage supply of DC power that is not sufficient on its own to generate a plasma. The voltage supply of DC power is provided in a second ratio of power over voltage that is less than the first ratio of power over voltage associated with the voltage supply of RF energy. The combined voltage from RF energy and DC power is sufficient to generate a plasma. As a result, a plasma is generated adjacent the electrode tip 372 of the second center conductor 354. Determination of the combined voltage sufficient to generate a plasma may be made by the controller 404 in response to conditions measured relative to the combustion chamber 403.

In alternative examples, the controller 404 is capable of modes of configuration in which more than 51 percent of the voltage sufficient to initiate a plasma at the distal end 372 is provided from the DC power source 390.

In alternative examples, introduction of the voltage supply of DC power is not limited to the particular virtual short location described above, but rather may be provided near any other virtual short that may be present so as to ensure that the high voltage DC power will have a minimal effect on the standing electromagnetic wave being formed by the RF power component, and to limit RF power from disturbing the DC power source.

In alternative examples, either, or both, the DC power source 390 and RF power source 401 may include their own dedicated controllers for directing the provision of a combination of power adequate to generate a plasma at the electrode tip 372; or either, or both, the DC power source 390 and RF power source 401 may be provided within a primary power source. Wherein the primary power source may be configured to control the power output between the DC power source 390 and RF power source 401. In varying examples, the controller 404 may be disposed before or after either or both of the DC power source 390 and the RF power source 401, and the controller 404 may equally be integrated within or without the physical components that house the DC power source 390 and the RF power source 401. The coupling of the RF power source 401 to the center conductors may be enabled by several means: inductive coupling (e.g., an induction feed loop), parallel capacitive coupling (e.g., a parallel plate capacitor), or non-parallel capacitive coupling (e.g., an electric field applied opposite a non-zero voltage conductor end). The particular coupling arrangement employed will depend on the choice of coupling means and the particular structure of the resonator cavities.

In alternative examples, the RF frequency cancellation resonator assembly 391 may be any component, or series of components, for isolating RF power from reaching the DC power source 390, including, but not limited to: a resistive element, a lumped element inductor, a frequency cancellation circuit. In alternative examples, the RF frequency cancellation resonator assembly 391 may be located in closer proximity to the DC power source 390, the RF frequency cancellation resonator assembly 391 may be located in closer proximity to the QWCCR assembly 300, or the RF frequency cancellation resonator assembly 391 may be located somewhere else between the DC power source 390 and the resonator assembly 300. It is desirable to remove the RF as close to the point of generation as possible to reduce the amount of energy lost to heating, and to keep a high quality factor in the resonator assembly.

In alternative examples, the teachings of the present disclosure may be applied to a resonator assembly containing as few as one QWCCR, or to assemblies containing multiple QWCCRs arranged in series. Regardless of the number of QWCCRs used, comparatively the introduction of a (higher voltage, lower power) voltage supply of DC power at a virtual short in combination with a (lower voltage, higher power) voltage supply of RF power will provide a more efficient system for generating a plasma in a greater range of combustion environments while reducing the overall energy requirements for improved combustion and improved overall engine efficiency. By using the voltage supply of DC power as described above, a very large electrical potential is introduced to the system with a negligible use of current or power, in comparison to the RF power used to generate a plasma.

Figure 5:
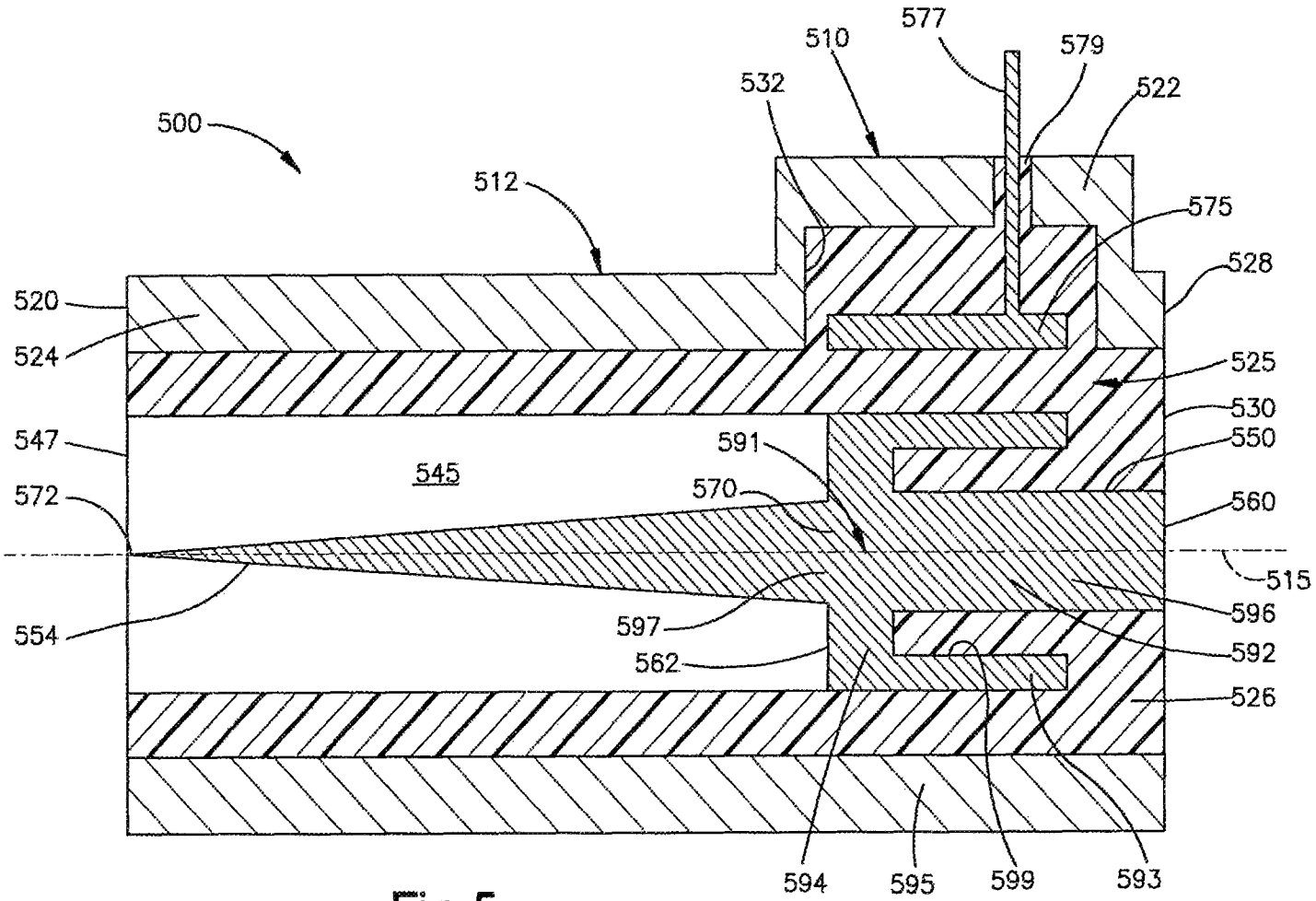
FIG. 5 is a cross-sectional view of an example of an exemplary coaxial cavity resonator assembly connected to a direct current power source through an additional resonator assembly acting as an RF attenuator.

In accordance with the present invention, an apparatus may further be configured using two resonators assembled in a series configuration to generate a plasma by applying a combined amount of voltage from radio frequency power and direct current power, such an apparatus 500 is shown for example in FIG. 5. In this particular example, the apparatus 500 includes first and second resonator portions 510 and 512 coupled in a series arrangement along a longitudinal axis 515.

In the illustrated example, the first and second resonator portions 510 and 512 are defined by a common outer conductor wall structure 520. The wall structure 520 includes first and second cylindrical wall portions 522 and 524 centered on the axis 515. The first wall portion 522 is constructed of a conducting material and surrounds a first cylindrical cavity 525 centered on the axis 515. In this example, the first cylindrical cavity 525 is filled with a dielectric material 526. An annular edge 528 of the first wall portion 522 defines a proximal end 530 of the first cavity 525. A proximal end of the second cylindrical wall portion 524 adjoins a distal end 532 of the first cavity 525.

The second center conductor portion 554 has a proximal end 570 adjoining the distal end 562 of the first center conductor portion 552, and projects along the axis 515 to a distal end 572 configured as an electrode tip located at or in close proximity to the distal end 547 of the second cavity 545.

An aperture 579 reaches radially outward through the first wall portion 522 through which a radial conductor 577 extends out from the longitudinal axis 515 for connection to the RF power source 401 by an RF power input line. The end of the radial conductor 577 that is closer to the longitudinal axis 515 connects to a parallel plate capacitor 575 that is in a coupling arrangement to the center conductor structure 550. The parallel plate capacitor 575 is also in a coupling arrangement to an inline folded RF attenuator 591.

In the illustrated example, a DC power source 390 is connected to the center conductor structure 550 at its proximal end 560 with a DC power input line. The inline folded RF attenuator 591 is disposed between the second resonator portion 512 and the DC power source 390 to restrict RF power from reaching the DC power source 390. The inline folded RF attenuator 591 includes an interior center conductor portion 592 having a first proximal end 596 and a first distal end 597. The inline folded RF attenuator 591 also includes an exterior center conductor portion 593 and a transition center conductor portion 594 that connects interior center conductor portion 592 and the exterior center conductor portion 593. The exterior center conductor portion 593 has a proximal end largely in the same plane as the first proximal end 596, and a distal end largely in the same plane as the first distal end 597. In this example, the transition center conductor portion 594 is located proximal to the first distal end 597. The exterior center conductor portion 593 surrounds the interior center conductor portion 592.

In this example, the exterior center conductor portion 593 resembles a cylindrical portion of conducting material surrounding the rest of the interior center conductor portion 592. The longitudinal lengths of the interior center conductor portion 592 and the exterior center conductor portion 593 are approximately equal to the longitudinal length of the parallel plate capacitor 575 that they are in coupling arrangement with. The electrical length between the first proximal end 596 to the first distal end 597, for both the interior center conductor portion 592 and the exterior center conductor portion 593, is approximately equal to one quarter wavelength. The second center conductor 554 and the second cylindrical wall portion 524 are both configured to have an electrical length of one quarter wavelength.

The wall structure 520 includes a short outer conducting portion 595 which has a proximal end largely in the same plane as the first proximal end 596, and a distal end largely in the same plane as the first distal end 597. An outer conducting path runs from the distal end of the wall structure 520 (that is substantially coplanar with the distal end 547 of the second cavity 545), along the short outer conducting portion 595, and stops at the proximal end 530 of the first wall portion 522. In this example, the outer conducting path has an electrical length of two quarter wavelengths.

An inner conducting path runs from the distal end electrode tip 572 to the proximal end 570 of the second center conductor portion 554, along the outside of the transition center conductor portion 594, then along the outside from the distal end to the proximal end of the exterior center conductor portion 593, then along the interior wall 599 of the exterior center conductor portion 593 from its proximal end to its distal end, then along the interior center conductor portion 592 from its distal end to its proximal end. In this example, the electrical length of this inner conducting path is four quarter wavelengths, or two half wavelengths. The difference in electrical lengths between the inner conducting path and the outer conducting path is one half wavelength.

This arrangement provides a radio frequency control component connected between the DC power source 390 and the voltage supply of RF energy. This particular example of a radio frequency control component is an inline folded RF attenuator 591 and is configured to shift a voltage supply of RF energy 180 degrees out of phase relative to the ground plane of the QWCCR assembly 500.

A person of ordinary skill in the art would understand that the particular QWCCR arrangement depicted in FIG. 5 is not limiting with regards to the orientation of the inline folded RF attenuator 591. In alternative examples, the entire QWCCR arrangement depicted in FIG. 5 may be 'stretched' whereby the inline folded RF attenuator 591 may be disposed further away from the distal end 572 and no longer directly coupled to the parallel plate capacitor 575, but rather separated by one quarter wavelength from the portion of the center conductor that would remain in direct coupling arrangement with the parallel plate capacitor 575. Alternatively, the entire QWCCR arrangement depicted in FIG. 5 could be more compressed whereby the exterior center conductor portions 593 of the inline folded RF attenuator 591 both extend longitudinally as far as the parallel plate capacitor 575 but also surround the portion of center conductor exposed for plasma creation. This may be implemented by arranging the transition center conductor portion 594 no longer just at the end of the inline folded RF attenuator 591 but in the middle so that the exterior center conductor portions 593 extend in either direction longitudinally. Any particular geometry of this arrangement would require tweaking to the various parameters of dielectrics to ensure impedance matching and full 180 degree phase cancellation, but these tasks are well understood engineering tasks.

In one example, the QWCCRs of the present invention and the particular combination of components that provide the RF signal to the QWCCR are contained in a body dimensioned approximately the size of the prior art spark plug 106 and adapted to mate with the combustion chamber of a combustion engine. More specifically, this example uses a microwave amplifier at the resonator and uses the resonator as the frequency determining element in an oscillator amplifier arrangement. The amplifier/oscillator would be attached at the top of the plug, and would have the high voltage supply also integrated in the module with diagnostics. This example permits the use of a single low voltage DC supply for feeding the module along with a timing signal.

In the context of this description various terms may refer to locations where as a result of a particular configuration, and under certain conditions of operation, a voltage component may be measured as close to non-existent. For example, "voltage short" may refer to any location where a voltage component may be close to non-existent under certain conditions. Similar terms may equally refer to this location of close-to-zero voltage, e.g., "virtual short circuit," "virtual short location," or "voltage null." Often times a person of ordinary skill in the art might limit the use of "virtual short" to only those locations where the close-to-zero voltage is a result of a standing wave crossing zero. "Voltage null" may at times more often be used to refer to locations of close-to-zero voltage for a reason other than as result of a standing wave crossing zero, e.g., voltage attenuation or cancellation. Moreover, in the context of this disclosure, each of these terms that can refer to locations of close-to-zero voltage are meant to be non-limiting, and instead only limited by their surrounding context including the particular dimensions and specifications of the application within which they are described.

Diagnostic Considerations and Uses

The coaxial cavity resonator can act as an antenna and can probe a combustion environment and react to changes in pressure, temperature, and impedance, among other things, before, during, and after a coronal plasma discharge. Information that can be used for diagnostic or control purposes is both available and can be gathered throughout each stage of a combustion process of a four-cycle engine. Similarly, such information can be gathered for 2-stroke engines as well.

It should be appreciated from reading this document that a variety or resonators can be used in conjunction with the systems and methods described below. For ease and simplicity of description, specific examples presented here refer to a QWCCR. Those people with an ordinary level of skill in this art area will appreciate that another resonator can be used in place of the QWCCR described and will also appreciate the minor modifications that can be made to use another resonator in a particular implementation.

A QWCCR can be used as a step-up amplifying device to increase electric field potential. The QWCCR can be exposed to an environment other than its internal coaxial environment. Various factors can affect operation and performance of the QWCCR, including design criteria and environmental conditions such as temperature, pressure, environment atmosphere composition, effects of capacitance, inductance, and electromagnetic radiation, among others. For example, small changes in the combustion environment can result in a measurable change in impedance and resonance frequency. Likewise, a change in operation of the resonator, such as a change in frequency or a change in power delivered, can affect the combustion process.

The system described below can be used to determine process and operating conditions inside a combustion environment in an internal combustion engine. The ability to monitor these conditions, such as process temperature and pressure, piston position, gas composition and impedance, and volume and instances of plasma formation, among others, can enable feedback and control actions to attempt to optimize and customize operation of the combustion process for various internal combustion engine systems and processes.

Frequency, Temperature, and Pressure

A fundamental principle in physics linking frequency, propagation velocity, and wavelength can be expanded to include a comparison of the propagation velocity to that of light in a vacuum. Additionally this can be expanded to include propagation through various mediums.

$$f_o\ [\mathrm{Hz}] = \frac{v\ [\mathrm{m/s}]}{\lambda\ [\mathrm{m}]} = \frac{v\ [\mathrm{m/s}]}{\lambda\ [\mathrm{m}]\sqrt{\mu_0\mu_r\varepsilon_0\varepsilon_r}} = \frac{c_0\ [\mathrm{m/s}]}{\lambda\ [\mathrm{m}]\sqrt{\mu_r\varepsilon_r}}$$

where f is the operating frequency, v is the wave velocity, λ is the wavelength, εr and ε0 are the relative and free-space permittivity, respectively, and μr and μO are the relative and free-space permittivity, respectively, and c0 is the speed of light in a vacuum.

A model such as the one presented in the equation above assumes for the vacuum case that permittivity and permeability of the medium are fixed, time-invariant values. This is not true in an internal combustion engine, where pressures and temperatures vary over time and with varying positions of a piston in a cylinder during a combustion cycle. The permittivity can be modified to include time-varying pressure and temperature.

$$\varepsilon_r(\theta, P, t) = 1 + [\varepsilon_{r_N}(\theta_N, P_N) - 1]\cdot\frac{\theta_N[K]\cdot P(t)[\mathrm{bar}]}{\theta(t)[K]\cdot P_N[\mathrm{bar}]}$$

where $\varepsilon_r$ is the calculated permittivity, $\varepsilon_r$N is the permittivity of gas/vapor under standard temperature and pressure, θ and P are the process temperature and pressure, respectively, and θN and PN are standard temperature and pressure.

In most cases, gaseous fuels are non-magnetic, or in rare cases paramagnetic in nature. In either of these cases, the contribution towards μr is so close to unity that it can be ignored.

This time-varying model can be substituted into the previous equation to achieve a time-varying frequency dependent on the process temperature and pressure.

$$f_o(\theta, P, t) = \frac{c_0}{\lambda\sqrt{1 + [\varepsilon_{r_N} - 1]\cdot\frac{\theta_N\cdot P(t)}{\theta(t)\cdot P_N}}}$$

Figure 6:
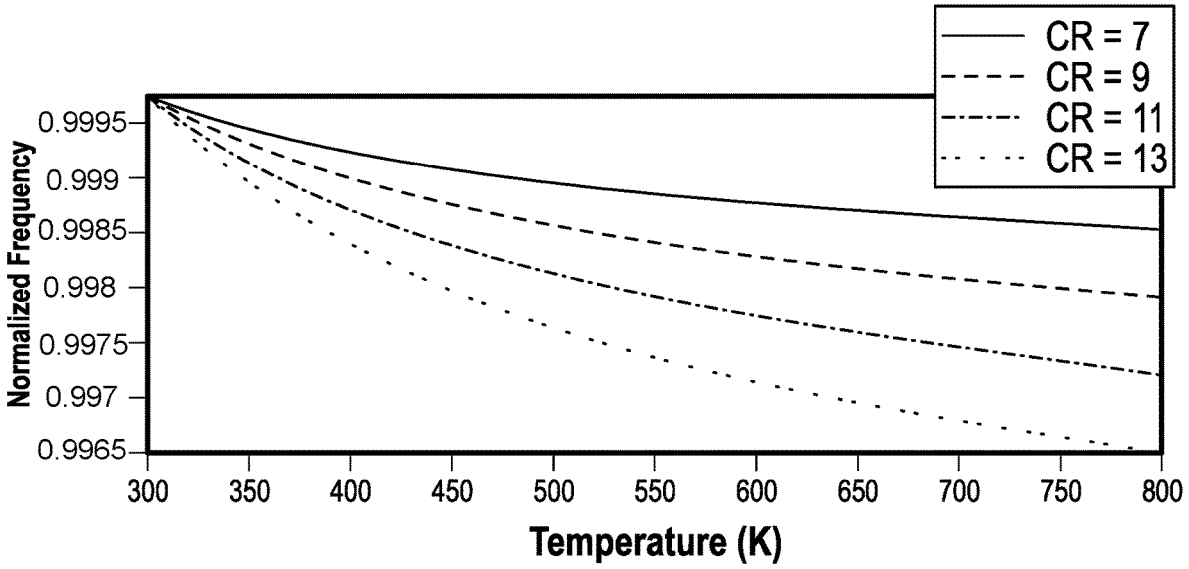
FIG. 6 is a plot diagram of temperature over frequency.
Figure 7:
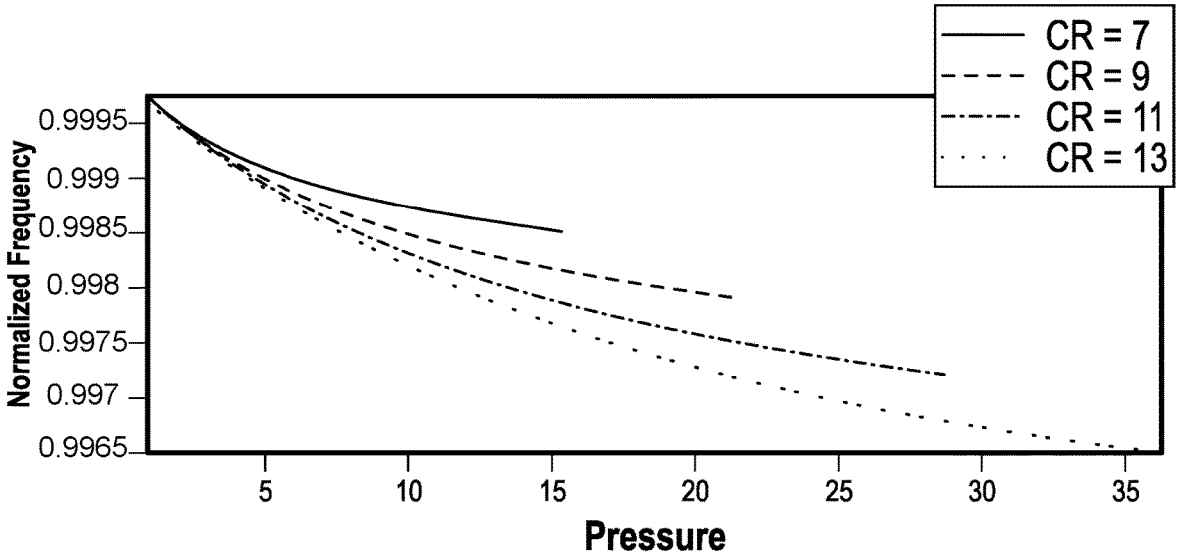
FIG. 7 is a plot diagram of pressure over frequency.
Figure 8:
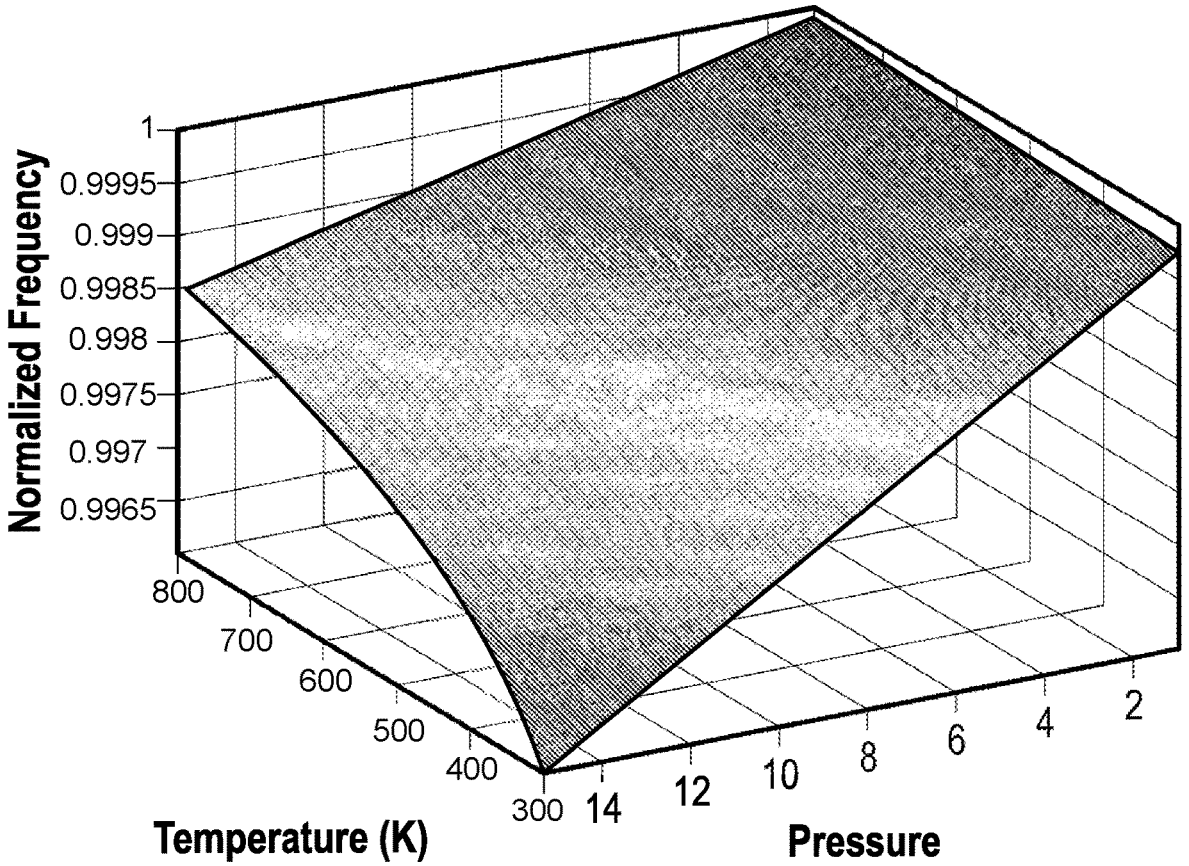
FIG. 8 is a graph of temperature, pressure, and frequency.

FIG. 6 and FIG. 7 each show a change in temperature vs. operating frequency (for a fixed pressure, $P_N$) and pressure vs. frequency (for a fixed temperature, $\theta_N$). FIG. 8 shows a surface of temperature vs. pressure, vs. frequency over the predicted operating conditions in a combustion environment.

These plots were made using εrN=1.000576 (permittivity of Nitrogen gas vapor, the primary constituent in the charge air) and the pressure range is based on the compression ratio when γ=1.3.

From this graph, a continuous relationship between temperature and pressure can be observed. Information regarding one data set, such as an initial set of conditions, can be used to track a combustion process across an entire range of operation.

Frequency and Power

When acting as a voltage step-up device, the QWCCR can use a specific, tuned radio frequency (RF) input signal to create a standing wave in the resonator cavity. An ideal, critically matched resonator will have a reflection coefficient of 0, when reflected and incident impedances are equal. For all other cases, there will be a percentage of the incident signal that will be reflected as a mismatch.

$$\Gamma = \frac{V_R[\mathrm{V}]}{V_I[\mathrm{V}]} = \frac{Z_R[\Omega] - Z_I[\Omega]}{Z_R[\Omega] + Z_I[\Omega]}$$

where Γ is the reflection coefficient $V_R$ and $V_I$ are voltages of the reflect and incident signal, respectively, and $Z_R$ and $Z_I$ are impendences of the reflect and incident signal, respectively.

The impedance of the QWCCR and other resonator cavities is based on contributions of resistance, inductance, and capacitance. How each compares in magnitude to the others can determine whether a load is inductive, capacitive, or purely resistive.

$$Z=\sqrt{R^2+(X_L-X_C)^2}$$

where $X_C$ and $X_L$ are the impedance of the inductor and capacitor, respectively, ω is the angular frequency, f is the operational frequency, and L and C are the inductance and capacitance of the cavity, respectively.

The components can be further expanded to include contribution and effect of other characteristics such as material, operational, and environmental, among others, that can alter and affect the QWCCR. These components of the impedance can include resistance (R), inductance ($X_L$), and capacitance (Xc).

$$R(\rho,\alpha,\theta)=R_0(\rho)\cdot[1+\alpha(\theta(t)-\theta_0)]$$

where R and $R_0$ is the calculated resistance and standard resistance, respectively, ρ is the material specific resistivity, a is the material specific coefficient of resistance, θ and $\theta_0$ are the process temperature and standard temperature, respectively.

$$X_L(\theta, P, t) = \omega L = 2\pi f(\theta, P, t)L(t)$$

$$X_C(\theta, P, t) = \frac{1}{\omega C} = \frac{1}{2\pi f(\theta, P, t)C(t)}$$

where $X_C$ and $X_L$ are the impedance of the inductor and capacitor, respectively, ω is the angular frequency, f is the operational frequency, and L and C are the inductance and capacitance of the cavity, respectively.

$$Z(\rho, \alpha, \theta, P, t) = \sqrt{R_0(\rho)\cdot[1+\alpha(\theta(t)-\theta_0)]^2 + \left(2\pi f(\theta, P, t)L(t) - \frac{1}{2\pi f(\theta, P, t)C(t)}\right)^2}$$

Additionally, presence of the coronal plasma formation can alter the electromagnetic characteristic of the QWCCR. The resonance frequency, $f_r$, will also then be dependent upon plasma formation, PF, as well as $f_r$ (θ, P, t, PF) and Z(p, a, θ, P, t, PF)).

One method of interpreting differences between reflected and incident impedances is to examine return loss. Return loss describes magnitude (in dB) of the signal that will be reflected. On this scale, a return loss of 0 dB means all of the signal will be reflected, and a return loss of −00 dB means none of the signal will be reflected.

$$\text{Return Loss}=20\log F \tag{10}$$

Equipment suited to measure return loss often cannot differentiate signals below approximately −60 dB. For ease of description, this will be treated in this discussion as the minimum return loss expected from measurement devices.

A measure of the ratio of reflected impedance versus incident impedance is the standing wave ratio (SWR), or while measuring the reflected voltage versus the incident voltage is the voltage standing wave ratio (VSWR)

$$SWR = \frac{1+|\Gamma|}{1-|\Gamma|} = \frac{1+\rho}{1-\rho}$$

where SWR and VSWR are the standing wave ratio and voltage standing wave ratio, respectively, F is the reflection coefficient, and p is the magnitude of the reflection coefficient.

Figure 9:
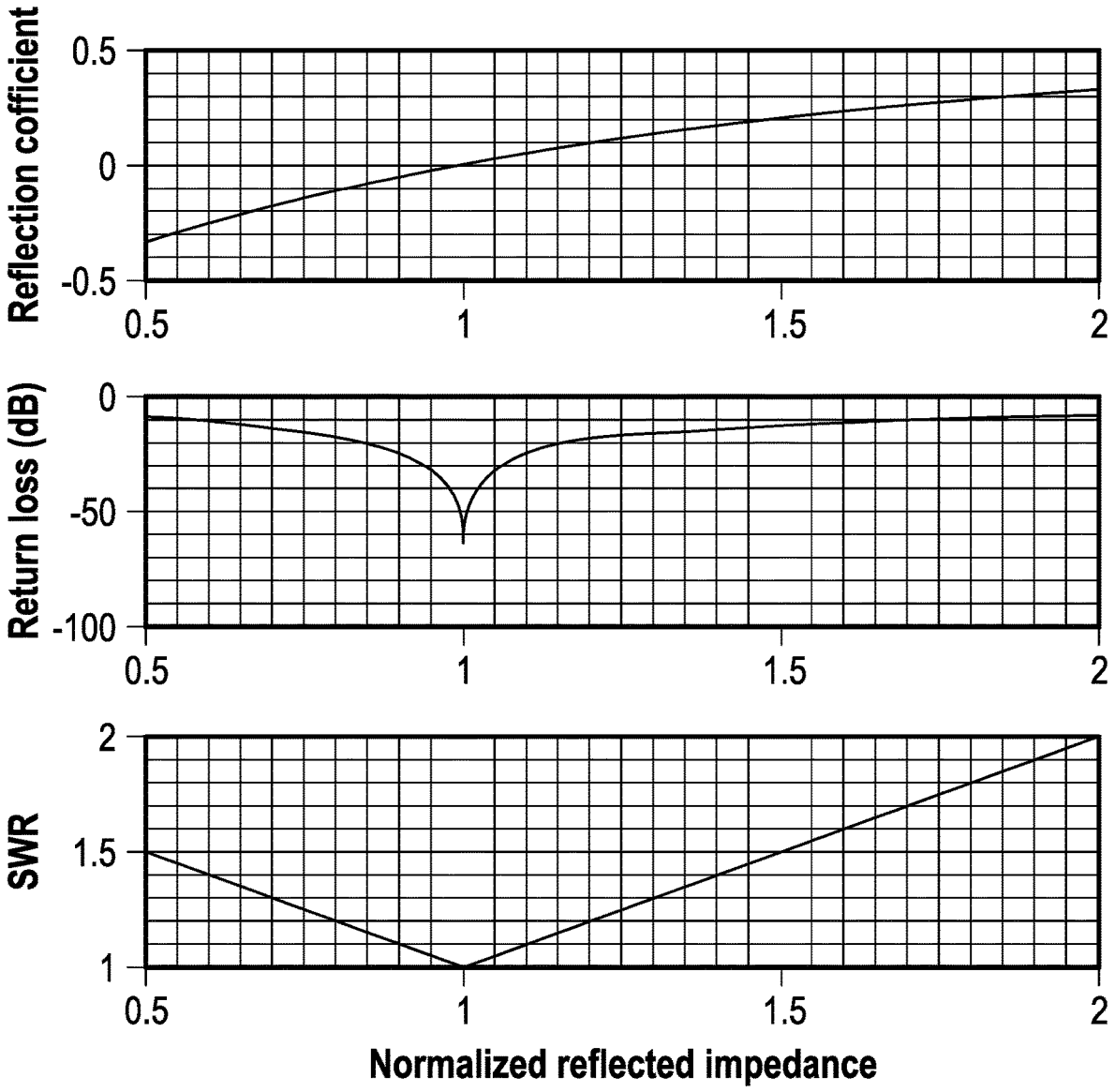
FIG. 9 is a set of plot diagrams.

The SWR and VSWR range between an ideally matched resonator is (SWR=1:1) and a perfectly unmatched resonator is (SWR=1:∞). FIG. 9 shows a plot of reflection coefficient, return loss, and standing wave ratio for a normalized reflected impedance.

Substituting, the dependencies of the SWR can be identified.

$$SWR(p, \alpha, \theta, P, t, PF) = \frac{1 + \dfrac{Z_R(\rho, \alpha, \theta, P, t, PF) - Z_I(\rho, \alpha, \theta, P, t, PF)}{Z_R(\rho, \alpha, \theta, P, t, PF) + Z_I(\rho, \alpha, \theta, P, t, PF)}}{1 - \dfrac{Z_R(\rho, \alpha, \theta, P, t, PF) - Z_I(\rho, \alpha, \theta, P, t, PF)}{Z_R(\rho, \alpha, \theta, P, t, PF) + Z_I(\rho, \alpha, \theta, P, t, PF)}}$$

SWR and VSWR disregard any information about the phase (p) of the impedance. Sensors can be added to detect condition changes and gather additional information to describe the inductance or capacitance of the resonator.

These dependencies can alter output of the QWCCR igniter and change the operational conditions. Some of these dependencies are altered in the design and some in the operational process. Table 1 shows how each dependency maps to a given characteristic.

TABLE 1

Design and operational characteristics of the QWCCR

| Characteristic | Variable | Description |
|---|---|---|
| Design | P | Material resistivity |
| | a | Material coefficient of resistance |
| Process | 0 | Process temperature |
| | P | Process pressure |
| | t | Process time |
| Operational | PF | Plasma formation |
| | fr | Resonance frequency |
| | fo | Operating frequency |
| | V | Voltage |
| | I | Current |

Values for the SWR and VSWR can be determined and recorded using currently available equipment.

The power required to energize the QWCCR and to create the coronal plasma is based on the amount of power that is input (for example, forward power, Pf) as well as the quality of the coupling in the resonator (for example, the SWR). Because power is related to the square of the voltage, the following model can be used to predict the power that will be reflected, $P_r$.

$$P_r(t, f_o) = P_f(t, f_o)\left(\frac{SWR(f_o)-1}{SWR(f_o)+1}\right)^2$$

where $SWR(f_o)$ is the standing wave ratio at the operating frequency $f_o$, and $P_r$ and $P_f$ are the time-varying reflected and forward power, respectively, at the operating frequency $f_o$.

By measuring, adjusting, and correcting data going into this multiple input system, a feedback and control scheme can be used to operate and attempt to optimize the operation of the ignition system of an internal combustion engine. More importantly, these same changes can be used as indicators of the quality, combustion development and the changes in the cylinder environment of the processing piston, through each cycle and position.

Feedback and Control

Previously identified were the process and operational characteristics involved in controlling the internal combustion process. Given this information, it is possible to design a feedback control scheme that can be used to attempt to optimize the performance and output of such a system.

Figure 10:
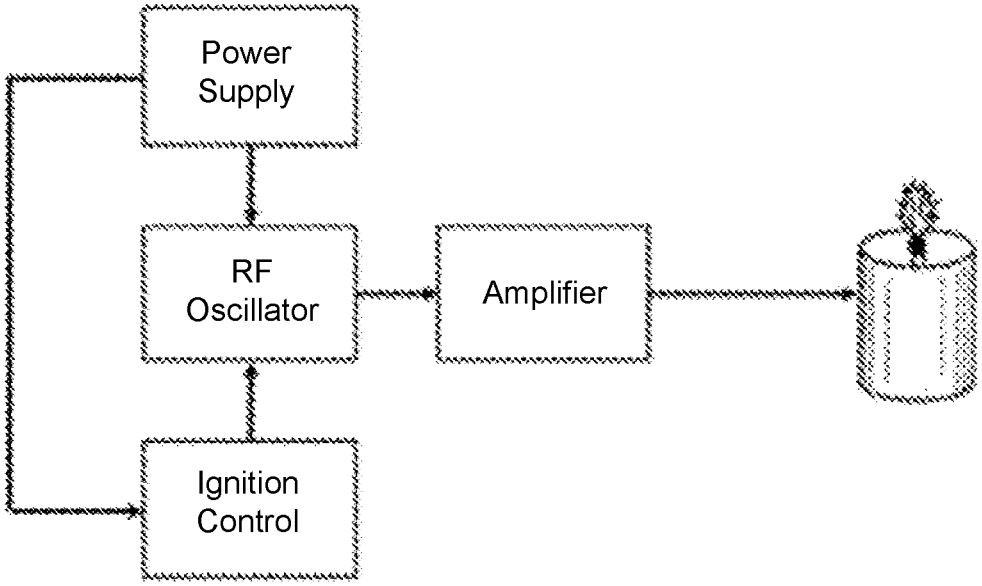
FIGS. 10-13 are system block diagrams of a plasma ignition system.
Figure 11:
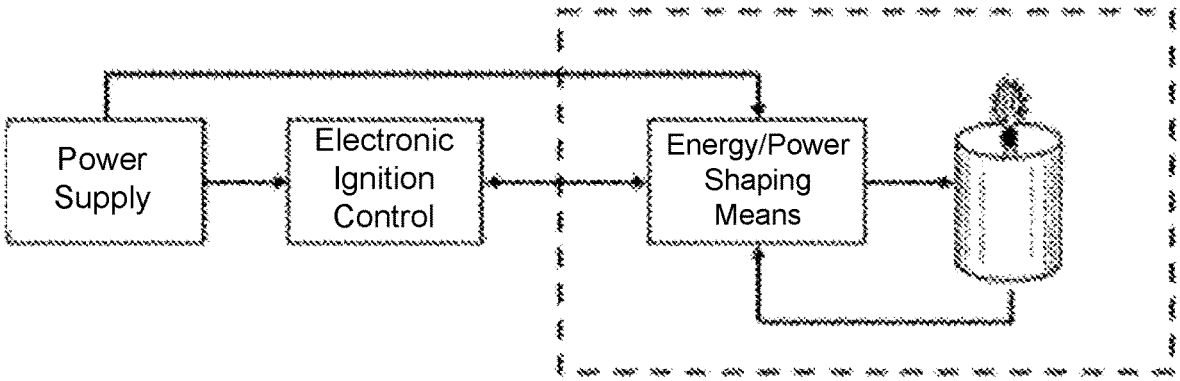

U.S. Pat. No. 5,361,737, incorporated here by reference, discloses a system where ignition is controlled by a QWCCR, powered by an amplifier, with a signal generated by an RF source. Resonance of the QWCCR can be created and powered by an energy/power shaper as disclosed in U.S. Pat. No. 7,721,697, also incorporated by reference. These can be seen in the diagrams in FIG. 10 and FIG. 11.

Figure 12:
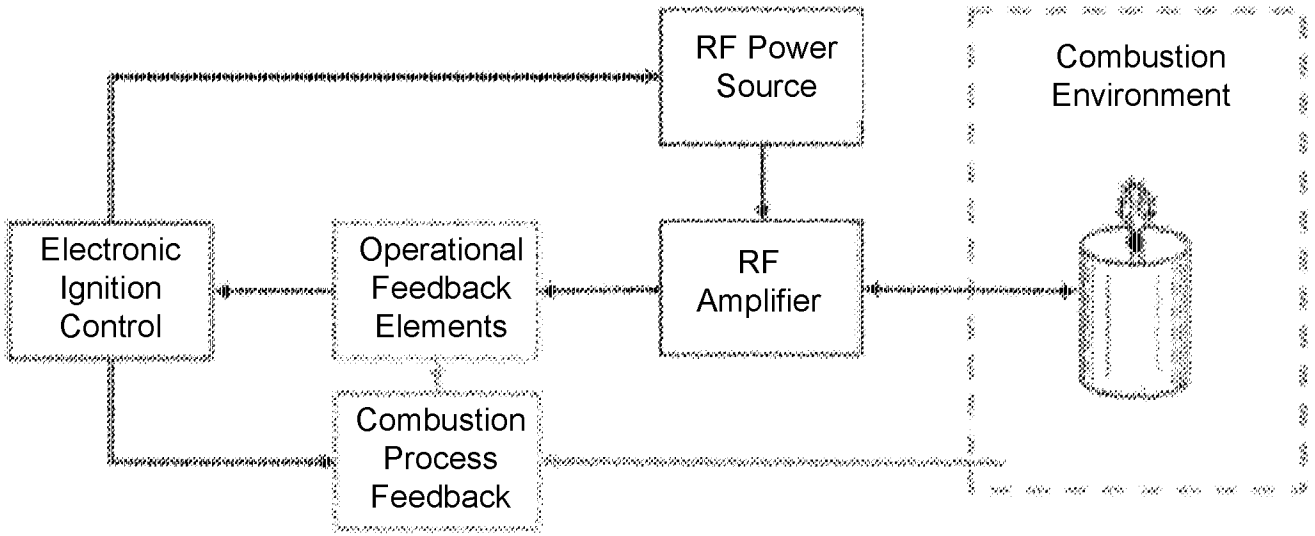

Missing from this control scheme is a feedback component, where operation and performance of the QWCCR and associated equipment can be controlled in accordance with the changes happening during the cycle-by-cycle variations in the combustion environment. FIG. 12 illustrates an exemplary plasma ignition system that includes a first feedback control system. In FIG. 12, the first feedback system includes operational feedback elements and combustion process feedback. As shown in FIG. 12, the RF amplifier is coupled to operational feedback elements and the combustion environment. The operational feedback elements are in turn coupled to the combustion process feedback and the electronic ignition control. As previously discussed, there are multiple conditions that can have an impact on the resonance and operating frequency of the QWCCR, and its efficiency.

The first feedback control system can use information from the combustion environment and electronic ignition control to create combustion process feedback information that can be used to augment ignition information based on the state of the ignition control as well as the cycle-by-cycle perturbations of the combustion environment. These can be coupled with operational feedback elements that can include the state and parameters (such as forward and reflected power, SWR/YSWR, timing, etc.) of the RF amplifier that will then be fed back into the "Electronic Ignition Control" and used for the next cylinder ignition state.

Figure 13:
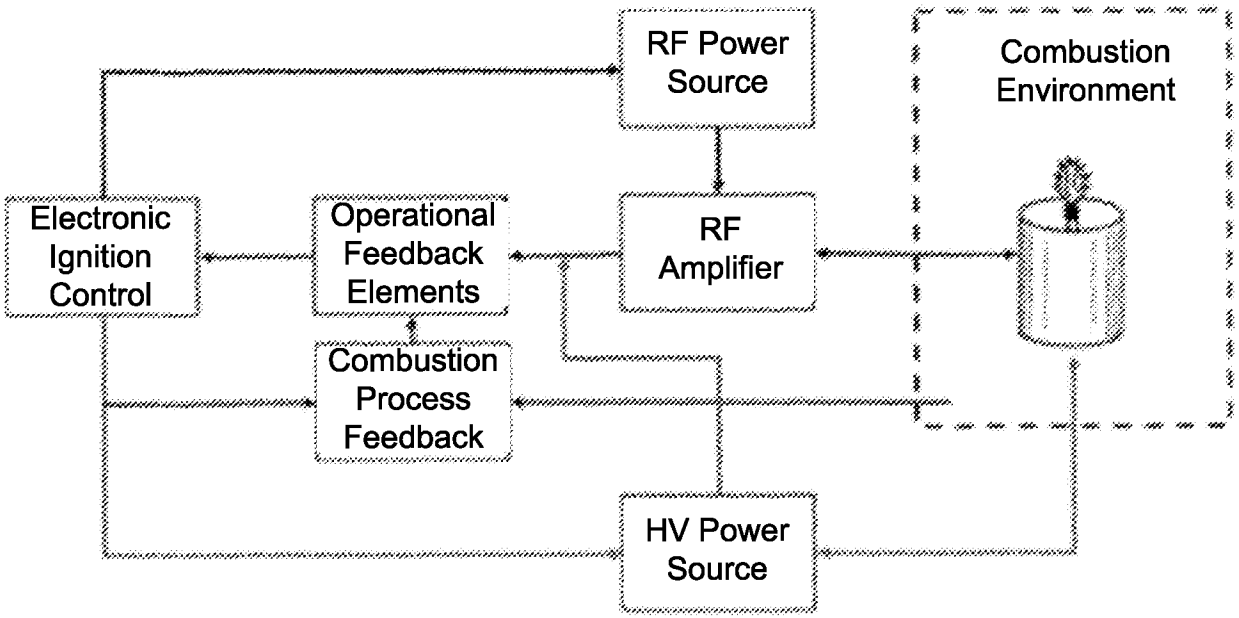
Figure 14:
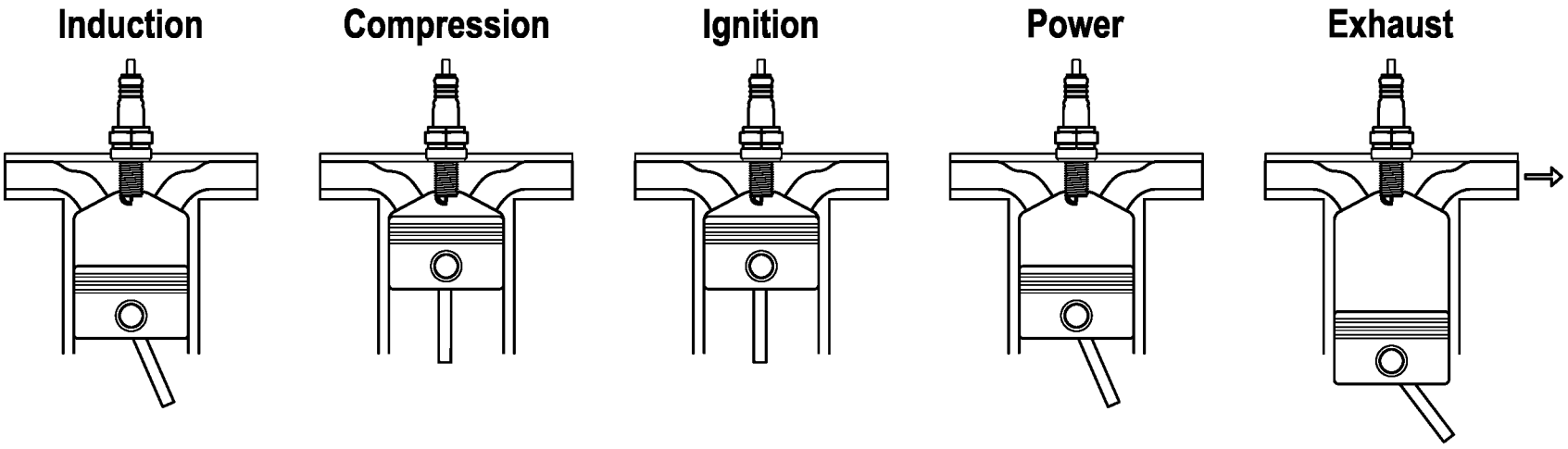
FIGS. 14-16 are perspective views of cylinders in combustion engines.
Figure 15:
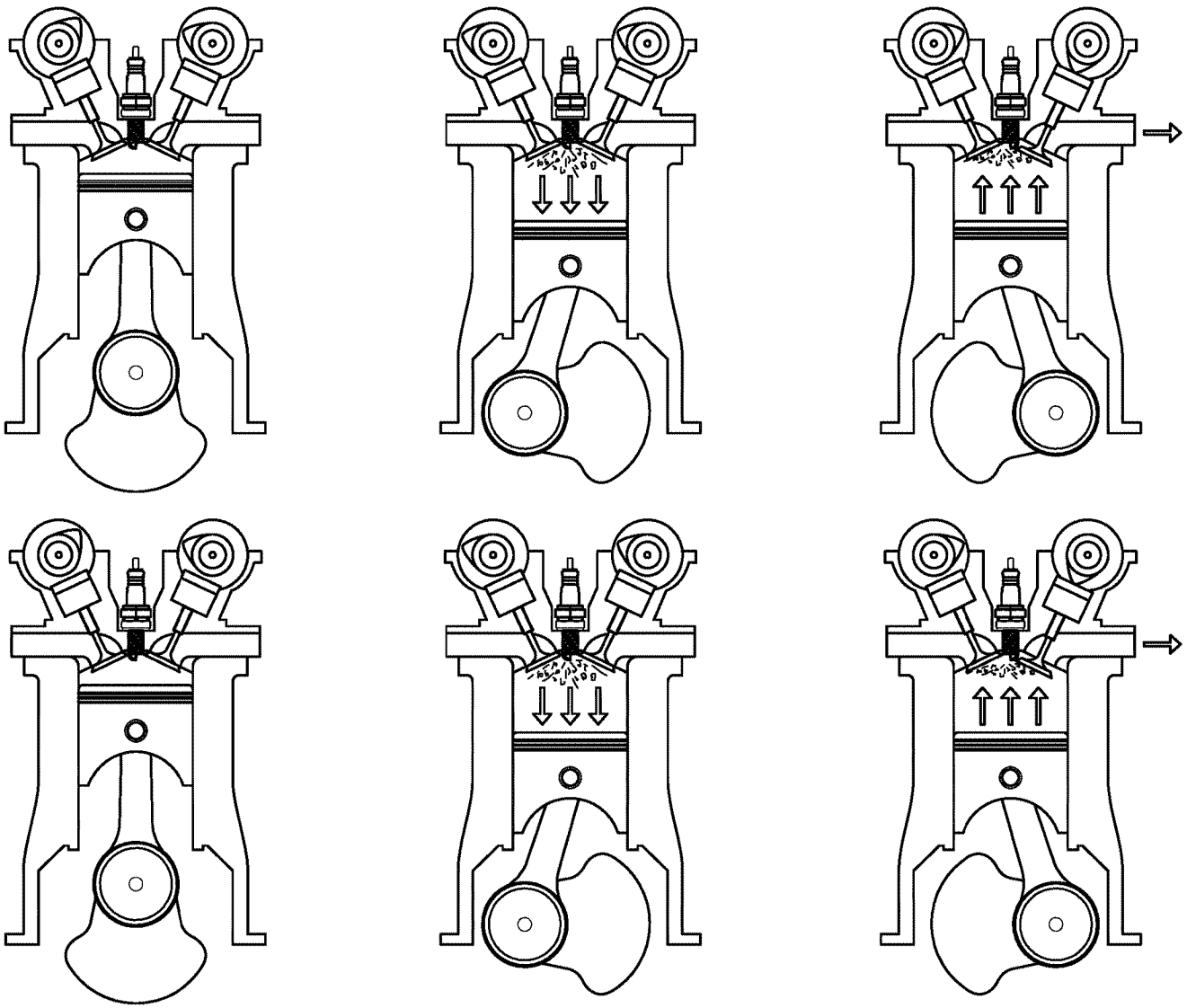
Figure 16:
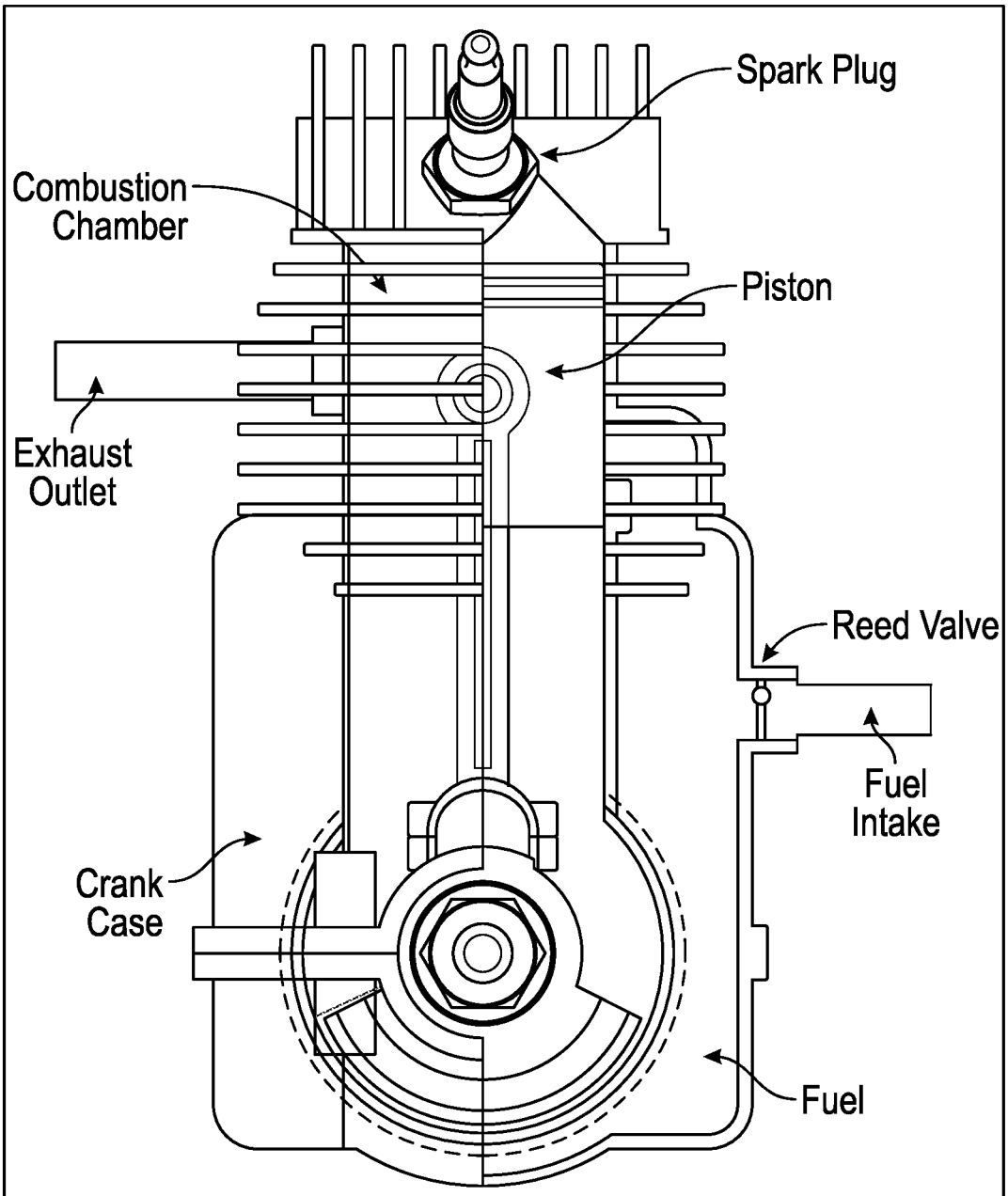

FIG. 13 illustrates an exemplary plasma ignition system that includes a second feedback control system. In FIG. 12, the second feedback system includes the operational feedback elements, the combustion process feedback, and the high voltage power source. This feedback scheme uses the same information presented in the previous embodiment, and also includes information regarding the high voltage (HV) DC power source. HV DC power source control will supply the timing and amount of DC power to be delivered to the QWCCR. HV DC Power source feedback will provide information on whether or not there was coronal plasma formation based on the amount of DC power used (specifically the voltage and current monitor). This information will be also fed into the "Operational Feedback Elements" to provide additional information to the "Electronic Ignition Control". As such, the HV DC power source is coupled to the operational feedback system, the electronic ignition control, and the combustion environment, as shown in FIG. 13.

In addition to the power sources, measurable data from pickup loops, transmission lines, circulators, thermocouples, pressure transducers, etc. can also be implemented as feedback elements and fed into either the "Combustion Process Feedback" or "Operational Feedback Control".

The Electronic Control Unit (ECU)

In this analysis the emphasis has been on the QWCCR and the use of the feedback data that is available for the processing and improvements of the delivered ignition control. Of equal importance, in the future development and use of IC Engines, will be the total control of the engine environment from the air and fuel delivered to the cylinder, to the combustion of the mix, and finally to the treatment of the expended products of combustion. Two critical elements are present in this invention, plus the prior inventions that spawned it, that to date have not been technical available but which have been widely discussed in the engine development community.

The first is the presence of an in-cylinder sensor to provide cycle-to-cycle diagnostics of the combustion environment, which the QWCCR currently provides. Most of the initial value of this diagnostic capability is related to the limits imposed by the Stoichiometric air/fuel ratio condition. This limit basically says that if given the proper amount of fuel and oxygen and adequate time all of the fuel will be consumed. In current engine ignition environments the goal is to get as close to this perfect mix as possible. Too rich a mixture wastes fuel and adds additional exhaust gasses (decreased fuel economy), and too lean a fuel mixture presents problems in poor ignition, or worse a miss-fire. Handling these lean mixtures will require a dynamic ignition control system as has been described here. It will require a system that can detect and alter the delivered energy, its form and timing, in the ignition source that is capable of cycle-to-cycle changes that current technology cannot accommodate.

The second advantage comes from the first. Since this technology can combust air/fuel ratios effectively without a Stoichiometric limit the ability to modify or modulate the injection of fuel, and air, based on the power demands of the driving environment now becomes a reality. Significant fuel use reductions can now occur at idle or at maintained speeds without sacrificing the need for power when the driving environment demands it. Larger engines can now appear to be smaller, in fuel consumption, (increased fuel economy) over a large portion of their driving cycle while still having the power needed for heavy load requirements.

The combination of these two elements allow the ECU to truly become an engine control unit that would sense the needs of the driver and deliver the correct amount of fuel and air to the cylinder per cycle. It would modify the energy and delivery of the same to the ignition system to maximize the work delivered and also signal the pollution control as to what is coming next, an ability that has not been exercised to date that we are aware.

It has been shown that changes in the size of the cylinder cavity, the normal reciprocation of the piston, impacts the measureable electrical characteristics of the QWCCR. While this could have potential value in less expensive engines through the elimination of the crank angle sensor, for the more sophisticated engines it would be difficult to beat the simplicity of the current sensor. What is important here is the reality that every change in the size, shape and atmospheric environment within the controlled environment of the combustion volume also has an impact.

Knowing the position of the piston becomes a backdrop and a standard to work all of the other characteristics against. Thus, each incremental change in the position of the piston, coupled with the injection of air, fuel and then the ignition process, is set against this backdrop, which can be subtracted from the mix since it is the expected standard.

All of this means that if each cylinder was properly instrumented then at each piston position and during each change in the cylinder environment (pressure and temperature change, fuel and air additions) including the combustion process there would be measurable parameters that could be used to modify the requirements for the next cylinder cycle. In fact if the sensors were responsive enough then modifications could be made during the same cycle, assuming you had the ability to alter the fuel and air injection rate (clearly a near-term possibility) and the ignition source could respond quick enough (which ours can).

Effectively the QWCCR in addition to being able to modify and moderate the ignition is that complete suite of sensors. Because of its duty cycle, which is orders of magnitude faster than the movement of the piston, there is the potential to continuously modify the cylinder environment and combustion process, real-time. This capability is the Holy Grail of the engine industry. Not only do they need the sensors that can read the dynamics of the combustion process, they want the ability to effect a change in that same dynamic environment; the QWCCR.

It is clear that we do not know the exact values for each of the variables in each of the combustion scenarios or for that manner for any of the engine designs and applications. In fact we don't need to know these at this point. It is only necessary for us to know we can measure those changes real-time and once we have the normal engine test data that all manufacturers require we can generate the look-up tables or the empirical equations needed to run the entire process. For these reasons, specific values are not given. Those values will vary across differing implementations.

This has been the nature of the beast for the past hundred years. The QWCCR now gives them a superior ignition process and the diagnostic capabilities to continuously improve the motive efficiency of their powerplants.

Description

As previously discussed, combustion environment conditions (temperature, pressure, atmosphere composition, etc.) and design criteria of the plasma igniter device (capacitance, inductance, electromagnetic properties, etc.) will be factors that affect the operation and performance. All of these dependencies will alter the output of the plasma igniter, and change the operational conditions. Table 1 shows how each dependency maps to a given characteristic (process or operational).

TABLE 2

Design and Operational Characteristics of the QWCCR

| Characteristic | Variable | Description |
|---|---|---|
| Process | 61 | Process temperature |
| | P | Process pressure |
| Operational | PF | Plasma formation |
| | f- | Resonance frequency |
| | fo | Operating frequency |
| | SWR | Standing Wave Ratio |
| | V | Voltage |
| | I | Current |

Having outlined some of the most basic characteristics, a detailed response of the system can now be discussed for all phases in a standard four-stroke combustion process. The following illustration, Table 3, will show the response of the process and operational characteristics during induction, compression, power, and exhaust phases as well as the ignition process itself, for a four-cycle engine. This process is somewhat different for two-cycle and rotary engines but the combustion process is effectively the same.

TABLE 3

| Process Characteristics | | | | | |
|---|---|---|---|---|---|
| Temperature | Large Increase | Increase | Unmeasurable | Large Decrease | Decrease |
| Pressure | Large Increase | Increase | Unmeasurable | Very Large Decrease | Slight Decrease |
| Operational Characteristics | | | | | |
| Plasma Formation | No | No | Yes | No | No |
| fR | Decrease | Decrease | Unmeasurable | Increase | Increase |
| fo | N/A | N/A | Resonance Frequency | N/A | N/A |
| SWR | »1:1 | >1:1 | approx. 1:1 (Before Ignition) | >1:1 | »1:1 |

This sample case is not indicative of how the resonator would respond to every condition in every combustion environment. Instead, this sample is meant to be an outline, guiding the interactions between process and operational characteristics and the feedback process.

The proposed microwave plasma resonator can be used as both as an ignition device, because of its ability to step up voltage and form coronal plasma, and a sensing device, because of its inherent resonance structure. However, because the presence of plasma in an enclosed, combustion-like environment distorts the electromagnetic properties of the resonance, the resonator can only be used as an ignition device or a sensing device at any given time. It is for this reason that there are characteristics in the table above marked as "Unmeasurable". The resonator has the ability to switch from a sensing device to an ignition device in fractions of a second (microseconds).

It should be noted that the preferred capabilities of the QWCCR is either as a sensor or as an ignition source. This does not mean that during the ignition process that there would not be measureable data. The issue would most likely be that the ignition event would so-overpower the sensor capabilities that this information would have less value. What we will most likely find is that each time the igniter fires we will gain a different type of data stream that will indicate the effectiveness of the ignition process. Again, this is a developmental aspect of the technology.

Additionally, this table of characteristics and their responses in during each phase of the combustion process can and will be expanded to incorporate a feedback and control scheme that will increase the efficiency and output of this type of internal combustion ignition system. The characteristics identified, and their response during the combustion process, in this disclosure, can also be used as a tool for process and system characterization and in-cylinder diagnostics, again, which is not currently available with a traditional DC spark ignited system.

Sensing and Ignition Timings of the QWCCR in a 4-Stroke Engine

The following is a brief discussion of the four stroke combustion process of an exemplary internal combustion engine that includes a combustion cylinder, a piston within the combustion cylinder, an intake valve and an exhaust valve. Such an internal combustion engine can be used to power an automobile, including a passenger car, a truck, or other type of passenger or freight vehicle. Phases of the combustion cycle include (1) initial position, (2) intake stroke, (3) compression stroke, (4) ignition, (5) power stroke, and (6) exhaust stroke. In the initial position, the piston is at its initial position, located at Top Dead Center (TDC). There is no fuel and no compression. The crankshaft sensor and QWCCR will measure that the piston is at TDC.

During the intake stroke, the piston moves from TDC to Bottom Dead Center (BDC) and the intake valve opens to draw in fresh, new oxygenated air for combustion. This stroke draws ambient pressure and temperature from the environment resulting in a change in pressure and temperature. This change in pressure and temperature affects the impedance in the QWCCR and, as a result, can be quantitatively measured using the standing wave ratio (SWR) measurement and the amount of reflected RF power.

During the compression stroke, the intake valve closes and the piston moves upward, to TDC. This compression changes the density of the air in the cylinder, and thus changes the impedance of the QWCCR. This change can be detected by the change in SWR of the QWCCR. As the piston approaches midway in its travel to the TDC position from BDC, the fuel injector injects pressurized, aerosolized fuel into the combustion chamber. The addition of fuel will also change the density and impedance of the cylinder, and can also be detected as a change by the QWCCR. The QWCCR can monitor changes in pressure, temperature, and other operating characteristics as a function of impedance, and this impedance can be determined by the measured SWR, reflected RF power, and characteristics of the DC power supplies. The three phases of the combustion process can be referred to as one of the zones the QWCCR can measure.

Ignition of the fuel-air mixture by the QWCCR can be initiated slightly before the piston reaches TDC. In this example, fuel ignition is a cascade reaction and in order to reach the maximum working potential in the next phase, the ignition is initiated early. The ignition phase is the second zone of measurement of the QWCCR. The results of the QWCCR as a sensing device will differ from the previous zone because the RF plasma will greatly distort the SWR and other pertinent measurements. Additionally, this measurement will occur at a point in compression by the piston where aerosolized fuel is present and the cylinder is experiencing near maximum temperatures and pressures.

The ignition of the fuel-air mixture forces the piston downward to BDC and turns fuel energy into mechanical energy. This is typically referred to as the power stroke, when the major portion of the kinetic energy is delivered.

The piston travels again from BDC to TDC, this time with the exhaust valve open. This exhaust stroke pushes all of the exhaust gases out of the cylinder so that the entire process can start over again. The ignition phase is the third zone of measurement of the QWCCR. This zone will be similar to the first, except now there will be remnants of the combustion process in the cylinder. Also, there will be much less impact of impedance due to pressure and temperature due to the exhaust process into the exhaust system. Differences in the impedance from this zone and the first zone can be used to instruct the exhaust system on how to better deal with the remaining exhaust gases and unspent fuel.

2-Stroke vs. 4-Stroke Engines

2-Stroke engines, also called 2-cycle engines, are different from 4-Stroke engines, in that there are only half the number of strokes (or twice the number of ignitions per cycle). To accomplish this, some of the phases in the 4-Stroke process are combined. For instance, phases (2) and (5) of the 4-stroke cycle are combined into the compression stroke of a 2-Stroke engine. Likewise, phases (3) and (6) of the 4-stroke cycle are combined into the power stroke of the 2-Stroke engine. Because there are no valves in an exemplary 2-Stroke engine, the motion of the piston and additional reservoirs are used for intake an exhaust.

Description of SWR and Measurement Techniques

In a Radio Frequency (RF) system, the Standing Wave Ratio (SWR) can be used to measure how efficiently the RF power is being delivered from the power source, through the transmission medium, and to the final destination (usually called the load). SWRs are typically associated with antenna systems (transmitters and receivers), and because the QWCCR can be used as an RF emitter, these same principles can be applied. This measurement technique can be employed because the impedance of such an antenna cannot typically be measured directly during its operation. Instead, in-line SWR meters can be used to measure the SWR either going to or being reflected by the load. Transmitters are typically tuned to certain conditions. Typically 50-Ohms and 75-Ohms are standards for impedance matching. When electrons are transmitted through a medium, they prefer to travel along a path of least resistance, and little change. If a source, a transmission path, and a load are all connected with a 50-Ohm impedance, there will be no reflected electrons (energy). Changes can create reflectance. The SWR measures this reflectance, and can then be used as a means to determine how much the impedance has changed.

The examples of the invention shown in the drawings and described above are exemplary of numerous examples that may be made within the scope of the appended claims. Additional examples of the invention may further include elements selected from any one or more of the prior art examples described above as needed to accomplish any desired implementation of the structure and function made available by the invention. It is the applicant's intention that the scope of the patent will be limited only by the scope of the appended claims.

Therefore, the following is claimed:

1. A method, comprising:

measuring at least one of a voltage value and a current value of a coaxial cavity resonator assembly in a combustion environment, the coaxial cavity resonator assembly comprising a conductor structure that extends through a first coaxial cavity resonator and a second coaxial cavity resonator;

determining a condition of the coaxial cavity resonator assembly by comparing the measured value to a known possible condition state; and modulating operation of the coaxial cavity resonator assembly based at least in part on the determined condition.

2. The method of claim 1, wherein the combustion environment is a cylinder of an internal combustion engine.

3. The method of claim 2, further comprising measuring a second condition of the combustion environment by using an auxiliary sensor.

4. The method of claim 3, wherein modulating operation of the coaxial cavity resonator assembly is further based at least in part on the second condition measurement of the combustion environment by the auxiliary sensor.

5. The method of claim 1, wherein modulating operation of the coaxial cavity resonator assembly comprises modifying an ignition of a combustible mixture in the combustion environment based at least in part on the determined condition.

6. The method of claim 1, wherein modulating operation of the coaxial cavity resonator assembly comprises modifying an amount of power provided to the coaxial cavity resonator assembly for a next cylinder cycle.

7. The method of claim 1, wherein the condition comprises a phase of a combustion cycle for an internal combustion engine.

8. The method of claim 1, wherein modulating operation of the coaxial cavity resonator assembly comprises modifying an ignition timing of the coaxial cavity resonator assembly in the combustion environment.

9. The method of claim 1, wherein the combustion environment is an internal combustion engine that is powering a motor vehicle.

10. The method of claim 1, wherein the coaxial cavity resonator assembly comprises at least one of a voltage monitor or a current monitor.

11. An apparatus for igniting a combustible mixture, comprising:

a coaxial cavity resonator assembly in a combustion environment, the coaxial cavity resonator assembly that comprises a conductor structure that extends through a first coaxial cavity resonator and a second coaxial cavity resonator;

an operational feedback system measures at least one of a voltage value and a current value of the coaxial cavity resonator assembly in the combustion environment;

a controller configured to determine a condition of the coaxial cavity resonator assembly by comparing the measured value to a known possible condition state; and the controller is configured to modulate operation of the coaxial cavity resonator assembly based at least in part on the determined condition.

12. The apparatus of claim 11, wherein the operational feedback system comprises at least one of a voltage monitor or a current monitor.

13. The apparatus of claim 11, wherein the combustion environment is a cylinder of an internal combustion engine.

14. The apparatus of claim 13, further comprising an in-cylinder sensor that is configured to measure a second condition of the combustion environment.

15. The apparatus of claim 14, wherein the controller is further configured modulate operation of the coaxial cavity resonator assembly based at least in part on the second condition measurement of the combustion environment by the in-cylinder sensor.

16. The apparatus of claim 11, wherein modulating operation of the coaxial cavity resonator assembly comprises modifying an ignition of a combustible mixture in the combustion environment based at least in part on the determined condition.

17. The apparatus of claim 11, wherein modulating operation of the coaxial cavity resonator assembly comprises modifying an amount of power provided to the coaxial cavity resonator assembly for a next cylinder cycle.

18. The apparatus of claim 11, wherein the condition comprises a phase of a combustion cycle for an internal combustion engine.

19. The apparatus of claim 11, wherein modulating operation of the coaxial cavity resonator assembly comprises modifying an ignition timing of the coaxial cavity resonator assembly in the combustion environment.

20. The apparatus of claim 11, wherein the combustion environment is an internal combustion engine that is powering a motor vehicle.

* * * * *